United States Patent [19]

Champley

[11] Patent Number: 4,980,983

[45] Date of Patent: Jan. 1, 1991

[54] DEVICE FOR FIXING A PICTURE OR THE LIKE WITHIN A FRAME

[76] Inventor: Jean-Marie Champley, 5, Square de la Vigne de la Cour, F-78450 Villepreux, France

[21] Appl. No.: 361,848

[22] Filed: Jun. 5, 1989

[30] Foreign Application Priority Data

Jun. 8, 1988 [FR] France ..... 88 07614

[51] Int. Cl.[5] ..... A47G 1/06

[52] U.S. Cl. ..... 40/156

[58] Field of Search ..... 24/517, 518, 67.3, 67.5, 24/67.7, 67 R; 40/156, 647, 152

[56] References Cited

U.S. PATENT DOCUMENTS

| | | | |
|---|---|---|---|
| 370,214 | 9/1887 | Smith | 40/647 |
| 380,951 | 4/1888 | Smith et al. | 24/518 |
| 1,908,469 | 5/1933 | Aanerud | 24/518 |
| 1,909,821 | 5/1933 | Feder | 24/518 |
| 3,310,901 | 3/1967 | Sarkisian | 40/156 |
| 3,596,392 | 8/1971 | Vani . | |
| 3,823,953 | 7/1974 | With | 24/517 X |
| 4,041,632 | 8/1977 | Sarkisian | 40/156 |

FOREIGN PATENT DOCUMENTS

| | | | |
|---|---|---|---|
| 97642 | 6/1898 | Fed. Rep. of Germany | 24/518 |
| 8102959.4 | 7/1981 | Fed. Rep. of Germany . | |
| 8313790.4 | 10/1983 | Fed. Rep. of Germany . | |
| 463378 | 2/1914 | France | 24/67.3 |
| 469508 | 3/1952 | Italy | 24/67.3 |
| 28695 | of 1912 | United Kingdom | 24/518 |

*Primary Examiner*—James R. Brittain

*Attorney, Agent, or Firm*—Young & Thompson

[57] ABSTRACT

A clamping spring in the form of an arch of resilient wire is mounted on a base which is fixed on the back of one side of a picture frame. The arch is capable of pivotal displacement about an axis which is parallel to the edge of the corresponding side of the picture frame. The lateral arms of the arch extend transversely and terminate in elbowed extremities which are pivotally mounted in the base. Transverse cheeks of the base are located on each side of the arch and are each provided with a flange or groove for locking the corresponding lateral arm of the resilient arch in its position of downward engagement against the base. In this position, the free end of the arch projects inwardly of the frame and is applied against the rear face of the picture. A picture is finally fixed in position when a similar device has been mounted on each side of the frame.

6 Claims, 4 Drawing Sheets

FIG.9
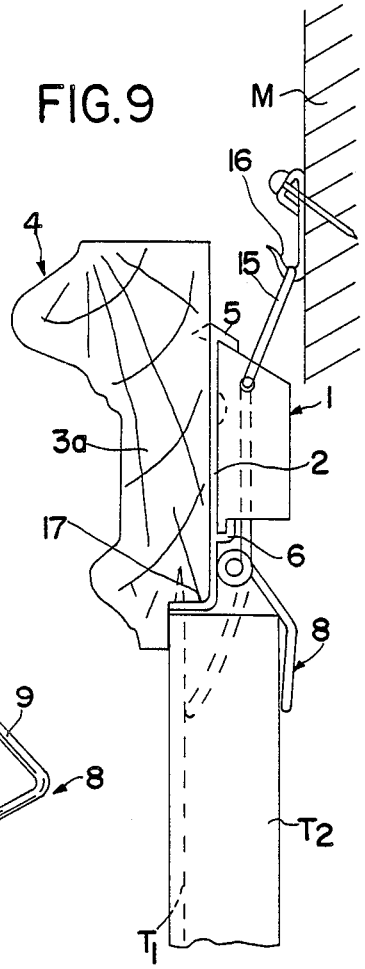
FIG.10
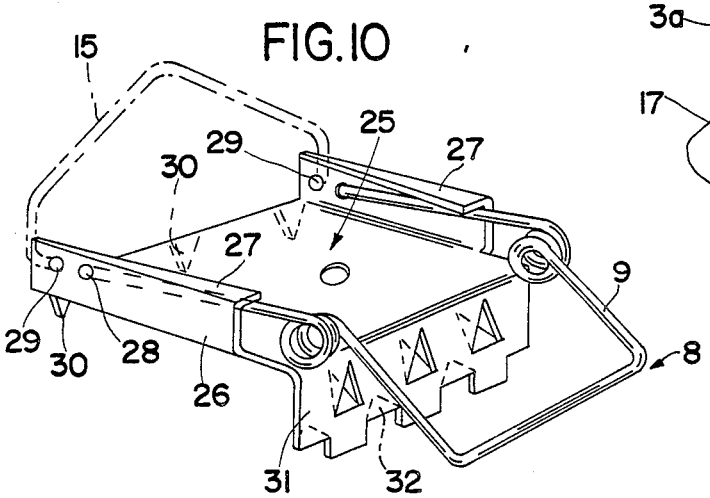
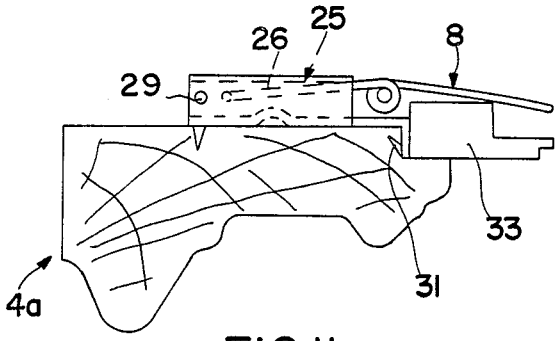
FIG.11

FIG.12
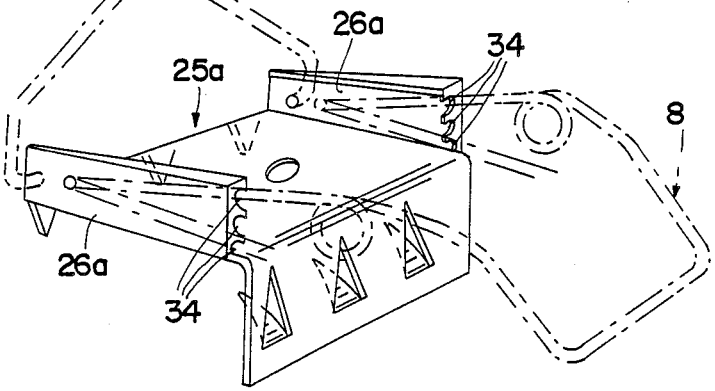
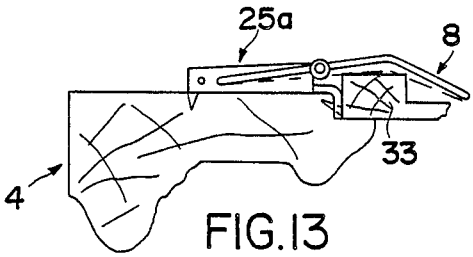
FIG.13
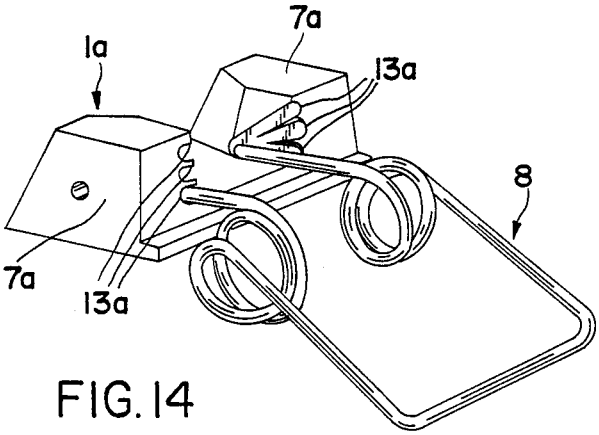
FIG.14

DEVICE FOR FIXING A PICTURE OR THE LIKE WITHIN A FRAME

BACKGROUND OF THE INVENTION

1. Field of the Invention

The present invention relates to the attachment of a picture or the like within a frame having an open channel at the rear for receiving the edges of said picture.

2. Description of the Prior Art

At the present time, an attachment of this type is effected either with nails or with pivoting clips forming springs which are in turn fixed on the corresponding picture frame by means of screws. However, these two solutions are both unsatisfactory since they are attended by a certain number of disadvantages. In fact, the first of these solutions is neither practical nor rapid. Furthermore, the penetration of nails into a frame is liable to cause damage to this latter. In addition, this solution is wholly unsuitable when consideration has to be given to the possibility of subsequent removal of a picture in order to replace it by another.

In regard to the solution which consists in making use of pivoting clips, this is also subject to disadvantages. In fact, these clips fail to ensure satisfactory attachment by reason of their very freedom of pivotal movement. Moreover, when frames equipped with clips of this type are stored for subsequent use, the presence of the clips proves to be a hindrance.

Finally, in one case as in the other, it is also necessary to provide additional means for hanging-up the picture frame on a wall, namely an eye screw or a cord attached to the back of the frame by means of two eye screws.

SUMMARY OF THE INVENTION

The present invention is therefore directed to a device which is intended to overcome these disadvantages, this device being so designed as to be capable of carrying out rapid and effective attachment of a picture within a frame.

Accordingly, the distinctive features of this device are as follows: said device includes a base which is provided with means for fixing against the back of one of the sides of a picture frame and on which a clamping spring is mounted for pivotal displacement about an axis extending parallel to the edge of the corresponding side of the frame, said clamping spring has the shape of an arch of resilient wire, the lateral arms of which are disposed in the transverse direction and terminate in elbowed extremities pivotally mounted in bearings provided in the base so as to define the axis of pivotal displacement of the clamping arch, the transverse edges of the base have cheeks located on each side of the lateral arms of said arch, each cheek being provided with a groove or a flange for locking the corresponding lateral arm of the resilient arch in its downwardly tilted position against the base in which the free end of the arch projects inwardly of the picture frame so as to be applied against the rear face of the picture placed within said frame.

Thus, in order to fix a picture within a frame, it is only necessary to mount a device of this type beforehand on the back of each side of said frame. Moreover, the fixing device placed on the back of the top side can be equipped with a fastener for hanging-up the corresponding picture frame on a suspension hook. Attachment of a picture within the frame thus equipped is a very easy operation since it is only necessary to place the picture in position and then to downwardly displace the resilient clamping arches of the corresponding fixing devices. Furthermore, by reason of the basic design concept of these devices, wholly effective attachment is accordingly achieved.

In a particular embodiment of the present device, the base of said device is constructed in two parts, namely a mounting-plate provided with means for attachment to the back of a frame, and a cleat on which is mounted the pivoting clamping arch, the mountingplate being provided with means for retaining said cleat such as, for example, longitudinal flanges forming an assembly guide.

In another embodiment, the base which carries the resilient clamping arch is formed in a single piece, namely a sheet-metal plate, the transverse edges of which are bent-back inwards so as to form flanges which are capable of retaining the lateral arms of the clamping arch in the downwardly-tilted work position of this latter.

BRIEF DESCRIPTION OF THE DRAWINGS

FIG. 9 is a vertical sectional view illustrating the use of a device in accordance with the invention both for fixing a picture in position and attachment of the corresponding frame to a suspension hook.

FIG. 10 is a view in perspective illustrating another embodiment of the device in accordance with the invention, the base which serves as a support for the resilient clamping arch being constructed in a single piece.

FIG. 11 is a sectional view which is similar to FIG. 7 but illustrates the use of a device in accordance with FIG. 10 for fixing a picture within a frame which is provided with a picture border or inner frame.

FIG. 12 is a view in perspective illustrating an alternative embodiment of the device shown in FIG. 10.

FIG. 13 is a view which is similar to FIG. 11 and corresponds to the use of a device in accordance with FIG. 12.

FIG. 14 is a view in perspective illustrating a variant of the spring cleat shown in FIG. 1.

DESCRIPTION OF THE PREFERRED EMBODIMENTS

Figure 1:
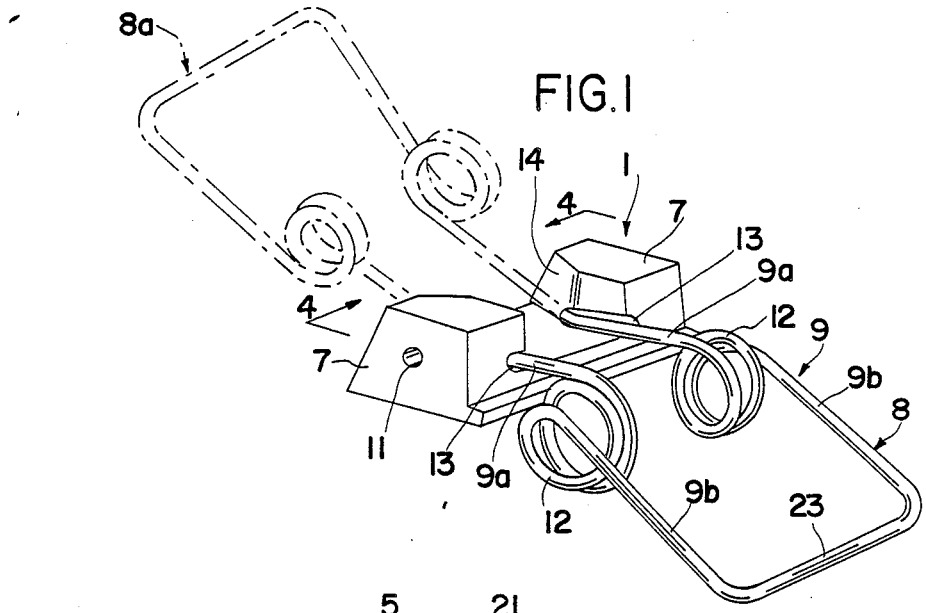
FIG. 1 is a view in perspective of the cleat which serves as a support for the resilient clamping arch, as shown in a first embodiment of the present device.

In the embodiment illustrated in FIGS. 1 to 9, the base which serves as a support for the clamping spring is made up of two components, namely a cleat 1 on which said spring is mounted and a mounting-plate 2 provided with means for attachment to the back of one of the sides 3 of a frame 4 for a picture or the like. On its longitudinal edges which are intended to be placed parallel to the edges of the corresponding side 3 of the picture frame, said mounting-plate has flanges 5 and 6 respectively which form a guide for receiving the cleat 1. One of these flanges, namely the flange 5, is simply raised in an inclined position whereas the other edge 6 is elbowed at right angles. The cleat 1 on the other hand has complementary shapes on each of its corresponding edges. The object of this arrangement is to facilitate mounting of the cleat by making it necessary for the operator to place this latter in the desired orientation.

Said cleat 1 is constituted by a part of molded plastic material, the top surface of which has a central recess between two projecting portions 7 located opposite to its transverse edges. In regard to the clamping spring which is mounted on said cleat, said spring consists of an arch 8 of drawn steel wire, the lateral arms 9 of which are disposed in the transverse direction. The terminal portions 9a of said arms are placed between the two projecting portions 7 which form framing cheeks. The extremities 10 of the lateral arms of the arch 8 are elbowed outwards and engaged in bores 11 formed at the base of the projecting portions 7 so as to constitute articulation bearings in which said extremities are pivotally mounted. These extremities thus define a pivotal axis X-Y which extends parallel to the longitudinal edges of the cleat 1 and therefore parallel to the edges of the corresponding side 3 of a picture frame when said cleat is in position.

Mounting of the resilient arch 8 on the cleat 1 is achieved by momentarily drawing together its lateral arms 9 so as to permit engagement of the elbowed extremities 10 of these latter within the bores 11, whereupon said arch is held in position simply by virtue of the elasticity of this latter. In consequence, the arch can be very readily removed by exerting compressive forces in opposite directions as represented by the arrows F in order to draw together the lateral arms 9 and thus to free their extremities 10 from the bores 11.

At an intermediate point of their length, the lateral arms 9 of the arch 8 are provided with helical turns 12 which increase the resilience of these latter. Moreover, said helical turns delimit two separate and distinct portions 9a and 9b which are inclined with respect to each other at a predetermined angle having a value $\alpha$ of 130°, for example.

In the standby position, the arch 8 occupies the position 8a which is shown in chain-dotted lines in FIG. 1 and in which said arch has been lifted above the cleat 1 towards the side remote from the location provided for a picture. However, said arch is intended to be brought into the work position which is shown in full lines in FIG. 1 and in which it has been tilted downwards on the opposite side. In this position, the terminal portions 9a of the lateral arms 9 are engaged within grooves 13 formed at the base of the internal wall of the projecting portions 7 of the cleat. These grooves determine shouldered portions which are located above the corresponding portions 9a of the lateral arms of the resilient arch and thus enable these latter to bear on the cleat 1 so that the arch 8 can apply a resilient pressure on the picture to be fixed in position.

The inner walls of the projecting portions 7 have beveled portions 14 constituting ramps, the function of which is to draw together the contiguous terminal portions 9a of the lateral arms of the arch 8 as this latter undergoes a pivotal displacement to its work position. This is intended to facilitate the resilient engagement of said terminal portions within the grooves 13.

Figure 4:
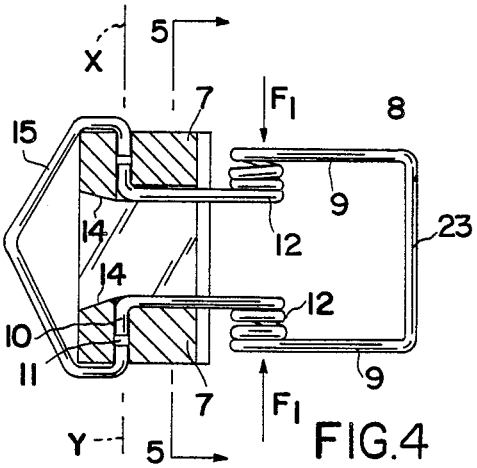
FIG. 4 a sectional view taken along line IV—IV of FIG. 1.
Figure 5:
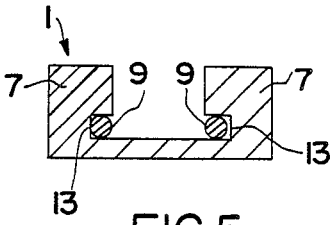
FIG. 5 is a transverse sectional view taken along line V—V of FIG. 4.
Figure 6:
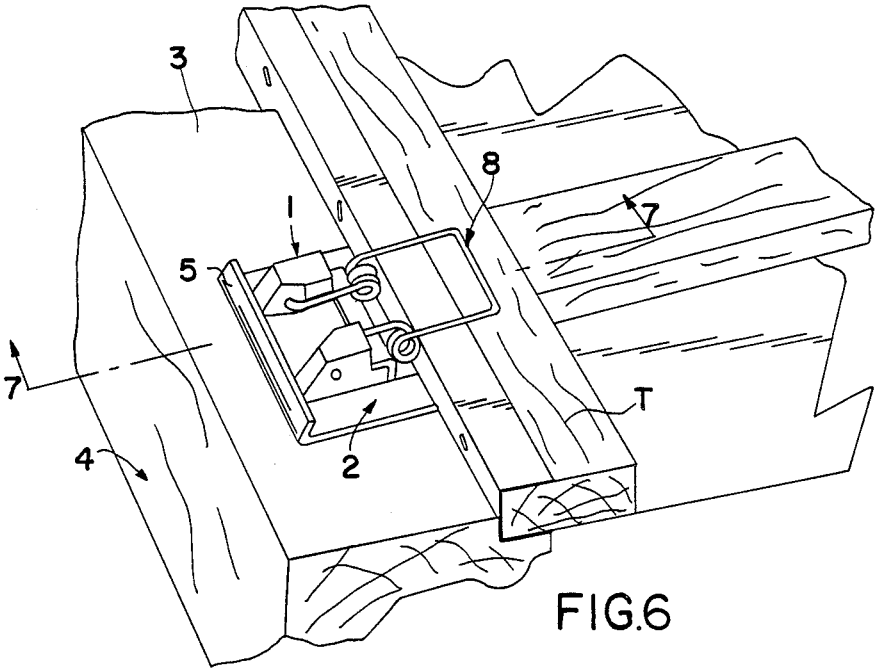
FIG. 6 is a view in perspective showing the present device in the position of utilization.

As is clearly shown in FIGS. 1 and 4, the bores 11 which serve as bearings for the extremities 10 of the lateral arms of the arch have their openings on the outer faces of the projecting portions 7. The external portions of said bores may thus serve to house the ends of a metal fastener 15 for attaching the corresponding device to a hook 16 which is fixed against a wall M in order to hang-up the picture frame 4 on the wall (as shown in FIG. 9). As will be readily apparent, a fastener 15 of this type is fitted only on the cleat 1 of the fixing device which is mounted on the back of the top side 3a of a picture frame.

Figure 2:
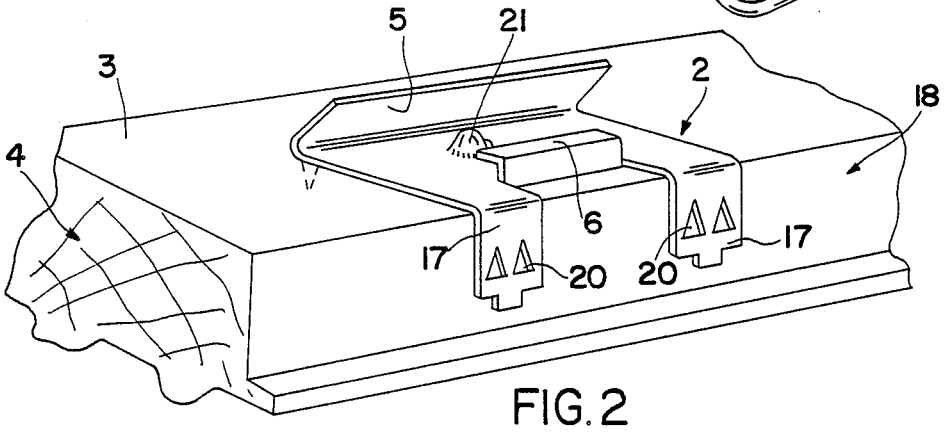
FIG. 2 is a view in perspective showing the mounting-plate which is intended to receive said cleat.

The mounting-plate 2 which is intended to receive the cleat 1 is constituted by a rolled casehardened steel plate which may have a thickness of 0.3 mm, for example. Said plate is provided with spikes or teeth 19 which are intended to penetrate into the material of the corresponding side 3 of a picture frame. As shown in FIG. 2, these spikes can be placed at both ends of the flange 5. However, other similar spikes can also be provided at other points of the plate 2, for example at the center of the surface of this latter, these spikes being in that case formed by punched-out perforations in said plate.

Figure 3:
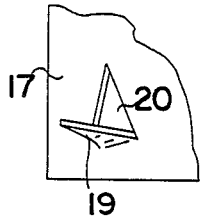
FIG. 3 is a perspective view showing a detail of said mounting-plate.

On the side corresponding to its flange 6, the mounting-plate 2 is provided with two elbowed extensions forming lugs 17 which are intended to be placed against the internal edge face 18 of the corresponding side 3 of a picture frame. In addition, these lugs are provided with spikes 19 which are intended to penetrate into the edge-face material itself, these spikes being formed by punched-out perforations 20 in the lugs 17 as shown in FIG. 3.

Said spikes 19 serve to ensure that the mounting-plate 2 is securely fixed in position in cooperation with the other spikes 19 which are also provided on said plate. In fact, spikes of this type penetrate very readily into the wood which constitutes the sides 3 of a picture frame and ensure wholly satisfactory attachment even in the case of wood of poor quality. However, the mounting-plate 2 is provided with a hole for adding a fixing screw if this proves indispensable.

Figure 8:
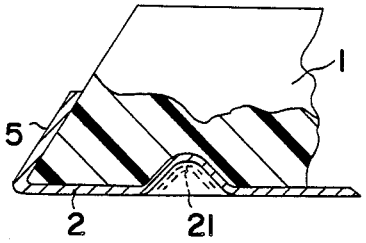
FIG. 8 is a fragmentary sectional view taken along the same plane but showing a particular detail which is drawn to a different scale.

Moreover, the mounting-plate 2 has a boss 21 formed by die-stamping. This boss is intended to penetrate into a corresponding recess formed in the bottom surface of the cleat 1 with a view to rigidly fixing this latter in its final position (as shown in FIG. 8).

It is worthy of note that the mounting-plate thus formed can be manufactured by means of a simple cutting and folding operation in a sheet-metal blank. This accordingly permits industrial production of said mounting-plate at extremely low cost.

In order to fix a picture T within a picture frame 4, it is recommended to equip four sides of said frame with fixing devices of the type described earlier. In the case of each side, it is only necessary first to place the corresponding mounting-plate 2 in position as shown in FIG. 2 and then to mount a cleat 1 on this latter. The clamping arch 8 carried by said cleat is at that moment located in the raised standby position 8a as shown in chain-dotted lines in FIG. 1 and is therefore directed away from the intended location of the picture T.

Figure 7:
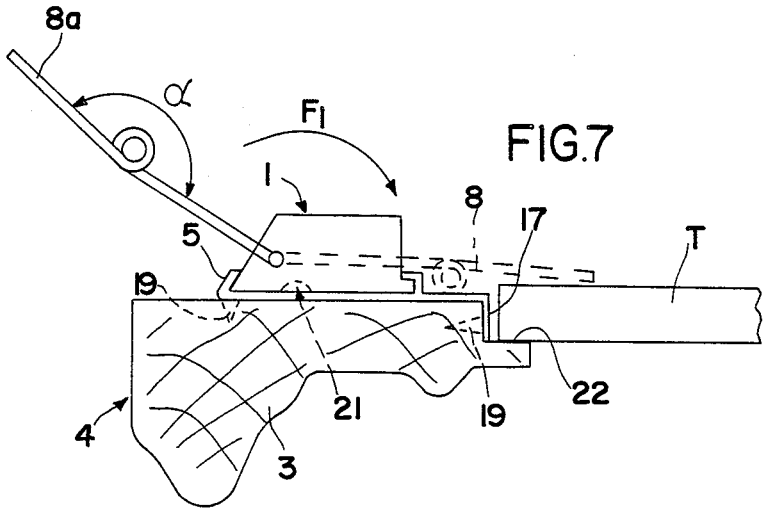
FIG. 7 is a corresponding sectional view taken along line VII—VII of FIG. 6.

When the edges of the picture have been placed within the channel 22 of the sides of the picture frame, the clamping arches 8 of the different fixing devices are tilted downwards to their clamping position by pivotal displacement in the direction of the arrow F1 (as shown in FIG. 7). This permits resilient engagement of said arches within the grooves 13, with the result that the central arm 23 of each arch is then resiliently applied against the back of the corresponding picture T and presses this latter against the bottom of the channel 22, thus ensuring that it is fixed in position. The lateral arms 9 of said arches are then applied against the shoulders formed by the top edges of the grooves 13 within which are engaged the terminal portions 9*a* of said lateral arms. It should be observed that, as the pressure exerted on a picture is greater, so the spikes for retaining the lugs 17 are more securely engaged in the material of the internal edge face 18 of the sides of the picture frame. This accordingly guards against any risk of displacement or detachment of the mounting-plates 2.

The result achieved by the elbowed shape of the lateral arms of the clamping arches is that these latter are capable of clamping in position pictures of very small thickness such as the picture T1 represented by a dashed line in FIG. 9. Conversely, however, by virtue of the elasticity of their lateral arms, the same arches are also capable of clamping pictures of substantial thickness such as the picture T2 of FIG. 9 which has a maximum thickness. These devices are thus capable of clamping pictures which vary between the two extreme limits of thickness, namely between 4 mm and 25 mm.

As has already been indicated, the fixing device which is separately mounted against the rear face of the top side of the picture frame is equipped with a fastener 15 in order to permit suspension of the complete assembly from a retaining hook 16 which is fixed against a wall. The thickness of the cleats 1 is so determined that their external surface comes into contact with the corresponding wall M even if the framed picture is painted on a canvas mounted on a frame having a maximum thickness of 25 mm. Moreover, this external surface is advantageously provided with rough excrescences of the so-called nail-head type, for example. Thus it is the rough surface of the cleats 1 which comes into contact with the wall and not the frame or the resilient clamping arches. This accordingly achieves good positional stability of the picture on the wall.

Should it be desired to remove the picture T from the picture frame 4, it is only necessary to produce a pivotal displacement of the clamping arches 8 to their raised standby position 8*a*. To this end, pressure should be exerted in opposite directions as shown by the arrows F on the lateral arms of said arches in order to release these latter from the grooves 13 of the cleats 1. If so required, the frame may subsequently be employed for framing another picture. Transfer of a frame from one picture to another can be carried out with great ease and very rapidly, which is an advantage for professionals such as art dealers. If necessary, the frames thus equipped can be stored in a standby position without fitting the clamping arches which are accordingly mounted at the last moment.

It is worthy of note that the present devices can also be used for the purpose of fixing a picture within a frame equipped with a picture border. In such a case, the lugs 17 of the mounting-plate 2 are engaged within the space existing between the inner edge face 18 of the sides of the frame and the outer edge face of the corresponding picture border.

FIG. 10 illustrates another embodiment of the device in accordance with the invention. In this embodiment, the base which carries the resilient clamping arch is not constructed in two parts as before but is constituted by a single part, namely a sheet-metal mounting-plate 25, the transverse edges of which are raised so as to form framing cheeks 26 for the lateral arms 9 of the corresponding resilient arch. Furthermore, these edges are then bent inwards so as to constitute flanges 27 which are intended to replace the shoulders formed by the grooves 13 provided in the cleat 1 of the preceding embodiment.

In the case under consideration, the corresponding clamping arch 8 is mounted directly on the present base-plate. This arch has the same general shape as in the preceding embodiment and the elbowed extremities 10 of its lateral arms 9 are engaged in holes 28 provided in the sides of the cheeks 26 so as to serve as rotational bearings for said extremities.

In the rest condition, the arch is raised in the same position as in the preceding embodiment. As in this latter case, said arch is subsequently intended to be swung back to the clamping position shown in full lines in FIG. 11, in which the terminal portions 9*a* of its lateral arms 9 are engaged beneath the flanges 27. It is therefore by means of these flanges that the clamping arch can be applied against its mounting base so as to exert pressure on the rear face of the picture to be fixed in position.

As is clearly apparent from FIG. 10, the flanges 27 have a bevel shape determining a widened portion of said flanges at the end which is directed towards the work position of the arch. Thus said flanges perform the function of ramps which have the effect of drawing-together the lateral arms of the arch during pivotal displacement of this latter to its work position in order to facilitate the engagement of said arms beneath said flanges.

The framing cheeks 26 formed on the base 25 are provided with additional holes 29 for subsequent mounting of a metal fastener 15 in order to suspend a frame from a hook 16 which is attached to the wall or the like, under the same conditions as before.

For the purpose of attachment to the back of one side 3 of a picture frame, the base 25 is provided with spikes 30 on the edge remote from the downward-tilt side of the resilient clamping arch 8. In regard to the longitudinal edge located on the side corresponding to the downwardly-tilted position of said arch, this edge is so arranged as to form a flange 31 which is intended to be applied against the internal edge face 18 of the corresponding side of a picture frame. This flange is provided with spikes 32 on its free edge. However, other spikes formed by punched-out perforations can also be provided at other points of the surface of said flange. These different spikes are intended to penetrate into the material of the edge face of the picture frame in order to fix the base 25 in position in conjunction with the spikes 29.

The mode of utilization and the operation of this fixing device are exactly the same as in the case of the preceding embodiment. In fact, when a fixing device of this type has been mounted on the back of each side of a picture frame, it is only necessary to tilt the resilient clamping arch 8 of each of these devices in the downward direction in order to fix a picture in position within the internal channel 22 of the corresponding picture frame. It should in any case be noted that this device can also be employed in the case of a frame equipped with a picture border 33 as shown in FIG. 11. In this case, the flange 31 of the base 25 is engaged within the space which exists between the internal edge face of the frame and the corresponding picture border 33.

FIG. 12 illustrates an alternative embodiment of the base 25 of FIG. 10. The corresponding base 25*a* differs from the preceding in the fact that the framing cheeks 26*a* of this latter are provided with a number of notches 34 located one above the other on the side corresponding to the position of downward tilt of the resilient clamping arch 8. These notches accordingly serve to lock said arch in a number of separate positions corresponding to different angles of slope (see FIG. 13). This makes it possible to modify the work position of said arch as a function of the thickness of the picture to be fixed in position. Perfectly effective clamping of said picture is thus obtained in each case.

As illustrated in FIG. 14, a similar solution may be contemplated in the case of the embodiment shown in FIGS. 1 to 9. In such a case, the cleat 1 may in fact be replaced by a cleat 1*a*, the transverse projecting portions 7*a* of which have a plurality of grooves 13*a* which are disposed at different angles of slope and are capable of receiving the terminal portions 9*a* of the lateral arms of the corresponding clamping arch 8. In this case also, it is possible to lock said arch in different work positions as a function of the thickness of the picture to be fixed in position.

However, many other variants of the fixing device in accordance with the invention may be contemplated. This device is indeed not limited to the embodiments which have been described in the foregoing and which have been considered solely by way of indication.

What is claimed is:

1. A device for fixing a picture within a frame, said device comprising a base having a flat undersurface lying in a plane, a clamping spring mounted for pivotal movement on the base, said clamping spring having the shape of an arch of resilient wire having lateral arms which are resilient and which terminate in elbowed ends pivotally mounted on the base for swinging movement between an open position and a closed position, said base having recesses thereon which receive and releasably retain said arms only in said closed position of said spring, and cheek means on said base which define a portion of said recesses and which can be passed by said arms only by resilient deformation of said arms upon movement of said spring from said closed position toward said open position, said elbowed ends being disposed above said plane, said arms extending from said elbowed ends beyond said base and passing through said plane and terminating in a cross piece that interconnects said arms and is disposed below said plane.

2. A fixing device according to claim 1, wherein the base of said device is constructed in two parts, namely a mounting plate provided with means for fixing on the back of a frame, and a cleat on which is mounted the spring, the mounting plate having longitudinal flanges forming an assembly guide for retaining said cleat.

3. A fixing device according to claim 2, wherein the mounting plate is constituted by a sheet-metal plate to be placed on the inside of a picture frame and having two elbowed extensions forming two lugs to be applied against an internal edge face of the corresponding side of said frame, said lugs having engagement teeth for penetrating into the material of said frame.

4. A fixing device according to claim 1, wherein the base which carries the spring is formed in a single piece which is a sheet-metal plate having transverse edges which are turned up and bent back inwards so as to form flanges which comprise said cheek means and are capable of retaining the arms of the clamping spring in its closed position, said sheet-metal plate having a downwardly-bent flange on an edge of said plate which is to be located on the inside of a picture frame, the last-named flange being adapted to be applied against an internal edge face of a corresponding side of said frame and having retaining teeth for penetrating into the material of said frame.

5. A fixing device according to claim 1, wherein the cheek means are located on each side of the arms of the clamping spring and each having a plurality of said recesses which differ from each other such as to make it possible to lock the clamping spring at different angles as a function of the thickness of the picture to be fixed in position.

6. In combination with a picture frame having an open channel at the rear end and a picture disposed in the frame with the edges of the picture in said open channel, a device comprising a base which is fixed against the back of the picture frame, a clamping spring mounted for pivotal movement on the base, said clamping spring having the shape of an arch of resilient wire having lateral arms which are resilient and which terminate in elbowed ends pivotally mounted on the base for swinging movement between an open position for emplacing or removing the picture in or from the frame, and a closed position in which the clamping spring bears against the back of the picture to hold the picture in the frame, said base having recesses thereon which receive and releasably retain said arms only in said closed position of said spring, and cheek means on said base which define a portion of said recesses and which can be passed by said arms only by resilient deformation of said arms upon movement of said spring from said closed position toward said open position.

* * * * *